US005281964A

United States Patent [19]

Iida et al.

[11] Patent Number: 5,281,964

[45] Date of Patent: Jan. 25, 1994

[54] TRAFFIC FLOW CHANGE MONITORING SYSTEM

[75] Inventors: Hideaki Iida, Tokyo; Joji Kamata, Yokohama; Ko Itoh, Machida; Masahiro Kojima, Kawasaki, all of Japan

[73] Assignee: Matsushita Electric Industrial Co., Ltd., Osaka, Japan

[21] Appl. No.: 768,295

[22] PCT Filed: Feb. 26, 1991

[86] PCT No.: PCT/JP91/00244

§ 371 Date: Oct. 4, 1991

§ 102(e) Date: Oct. 4, 1991

[87] PCT Pub. No.: WO91/13418

PCT Pub. Date: Sep. 5, 1991

[30] Foreign Application Priority Data

Feb. 26, 1990 [JP] Japan ..... 02-44900
Feb. 26, 1990 [JP] Japan ..... 02-44901

[51] Int. Cl.[5] ..... G08G 1/01

[52] U.S. Cl. ..... 340/933; 340/934; 340/936; 340/937; 340/942

[58] Field of Search ..... 340/933, 934, 936, 937, 340/941, 942, 943

[56] References Cited

U.S. PATENT DOCUMENTS 3,906,438 9/1975 Kohnert .
4,201,908 5/1980 Johnson et al. .

FOREIGN PATENT DOCUMENTS 1420636 11/1965 France .
593800 10/1977 Japan .
01-84600 7/1989 Japan ..... 340/933
0168398 6/1990 Japan ..... 340/936
02-53499 10/1990 Japan ..... 340/934
02-84297 11/1990 Japan ..... 340/934
945381 12/1963 United Kingdom .
1027880 4/1966 United Kingdom .

OTHER PUBLICATIONS

Peter Uriot, et al "Das Optimum finden, Anwendungsbeispiel: Verkehrsfluss-Messystem fur Schnellstrassen", Elektronik, vol. 34, No. 16, Aug. 9, 1985, pp. 77-82.

*Primary Examiner*—John K. Peng
*Assistant Examiner*—Nina Tong
*Attorney, Agent, or Firm*—Stevens, Davis, Miller & Mosher

[57] ABSTRACT

A traffic flow change monitoring system is disclosed, which uses data obtained from a vehicle perceiving sensor placed on a road and which can detect a traffic congestion or an unexpected event. Since a change in traffic flow is monitored on the basis of the speeds or the like of individual vehicles and the distances between successive vehicles, it is possible to monitor a positional relationship between successively running vehicles Also, it is possible to make a prompt detection of an unexpected event such as an accident by detecting a change in relative vehicle speed difference between traffic lanes at each measurement spot.

2 Claims, 4 Drawing Sheets

(a)

(b)

TRAFFIC FLOW CHANGE MONITORING SYSTEM

TECHNICAL FIELD

The present invention relates to a traffic flow change monitoring system for collecting and analyzing information concerning road transportation to provide accurate information to users of a road.

BACKGROUND ART

In recent years, as social demands for information offering services to drivers have been increased replenishment of a transportation control system to support such services has been required. Especially, there is a need to improve the function of a traffic flow change monitoring system for grasping changes in traffic flow more rapidly and more accurately.

The conventional traffic flow change monitoring system will now be explained on the basis of the drawings.

FIG. 5 is a block diagram showing the construction of the conventional traffic flow change monitoring system.

In FIG. 5, reference numeral 1 designates vehicle perceiving sensors such as ultrasonic sensors placed on a road, numeral 2 designates a signal detection section for detecting vehicle perception signals from the vehicle perceiving sensors 1, and numeral 3 designates a vehicle perception data compiling section for compiling the vehicle perception signals detected by the signal detection section 2 as a parameter such as a vehicle speed.

Numeral 4 designates a vehicle perception data classification section which ranks vehicle perception data compiled by the vehicle perception data compilation section 3 by means of predetermined threshold values concerning vehicle perception data.

Numeral 5 designates a change judgement section which judges a change in traffic flow by monitoring a time-dependent change of the result of ranking of the vehicle perception data by the vehicle perception data classification section 4. Numeral 6 designates an output section for outputting the result of judgement by the change judgement section 5.

Next, explanation will be made of the operation of the above-mentioned conventional system.

When a vehicle running on a road passes a perception range of the vehicle perception sensor 1, the signal perception section 2 detects the passage of the vehicle as a vehicle perception signal. This vehicle perception signal is compiled in the vehicle perception data compilation section 3 as a parameter such as a pulse indicative of a signal detecting time corresponding to the speed of the vehicle and the compiled vehicle perception data is sent to the vehicle perception data classification section 4 in a block at every unit time.

In the vehicle perception data classification section 4, the predetermined threshold values and parameterized vehicle perception data are compared to classify the individual vehicle perception data. The result of classification is sent to the change judgement section 5 which in turn monitors a time-dependent change of the result of classification of the vehicle perception data at a same measuring spot to judge a change in traffic flow. The result of judgement is outputted from the output section 6.

In this manner, even the above-mentioned conventional traffic flow measuring system can monitor a change in traffic flow by processing vehicle perception signals obtained from the vehicle perceiving sensors.

However, in the above-mentioned conventional traffic flow monitoring system, since the change in traffic flow is monitored in accordance with the speed or the like of individual vehicles, it is not possible to monitor a positional relationship between successively running vehicles. Accordingly, there is a problem that it is not possible to make a prompt forecast of occurrence and dissolution of a traffic congestion and to make a prompt detection of an unexpected event such as an accident.

An object of the present invention is to solve the above problem in the prior art and to provide an excellent traffic flow change monitoring system which is capable of promptly and accurately detecting a change in traffic flow.

DISCLOSURE OF INVENTION

To attain the above object, the present invention is provided with a signal detection section for detecting a vehicle perception signal from a vehicle perceiving sensor placed on a road, vehicle perception data compilation means for generating vehicle perception data from the vehicle perception signal detected by the signal detection section, vehicle perception data classification means for classifying the vehicle perception data, inter-vehicle distance data compilation means for generating inter-vehicle distance data from the vehicle perception signal detected by the signal detection section, inter-vehicle distance data classification means for classifying the inter-vehicle distance data, and change judgement means for judging a change in traffic flow in accordance with the result of classification of the vehicle perception data and the result of classification of the inter-vehicle distance data.

With the above construction, in the present invention, a change in traffic flow is monitored on the basis of both the speed or the like of individual vehicles and the distance between successive vehicles. Accordingly, it is possible to monitor a positional relationship between successively running vehicles and it is therefore possible to make a prompt forecast of occurrence and dissolution of a traffic congestion and to make a prompt detection of an unexpected event such as an accident.

BEST MODE FOR CARRYING OUT THE INVENTION

An embodiment of the present invention will now be explained on the basis of the drawings.

Figure 1:
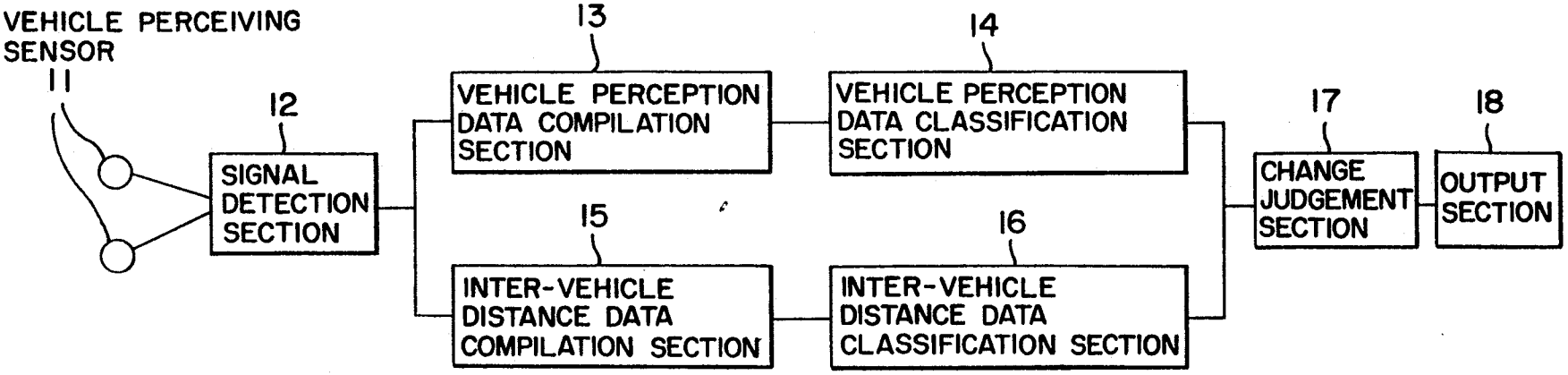
FIG. 1 is a block diagram showing the construction of a traffic flow change monitoring system according to an embodiment of the present invention.

FIG. 1 is a block diagram showing the construction of a traffic flow change monitoring system according to the embodiment of the present invention.

In FIG. 1, reference numeral 11 designates vehicle perceiving sensors such as ultrasonic sensors placed at individual measuring spots on a road for detecting vehicles, numeral 12 a signal detection section for detecting a vehicle perception signal from each vehicle perceiving sensor 11 and classifying the vehicle perception signal into a vehicle existence signal corresponding to the speed of a vehicle and a vehicle non-existence signal corresponding to a distance between vehicles, numeral 13 designates a vehicle perception data compilation section as means for summing up vehicle existence signals obtained through classification by the signal detection section 12 at every unit time to generate vehicle perception data corresponding to an average vehicle speed, and numeral 14 designates a vehicle perception data classification section as means for ranking the vehicle perception data into, for example, at least three classifications by use of predetermined reference values for respective ranks concerning vehicle perception data, that is, a plurality of threshold values.

Numeral 15 designates an inter-vehicle distance data compilataion section as means for summing up vehicle non-existence signals obtained through classification by the signal detection section 12 at every unit time to produce inter-vehicle distance data corresponding to an average distance between vehicles, and numeral 16 designates an inter-vehicle distance data classification section as means for ranking the inter-vehicle distance data into, for example, at least three classifications by use of predetermined reference values for respective ranks concerning inter-vehicle distance data, that is, a plurality of threshold values.

Numeral 17 designates a change judgement section as means for judging a change in traffic flow by comparing the results of ranking of the vehicle detection data and the inter-vehicle distance data with a predetermined combinative decision value and monitoring a time-dependent change of the result of comparison, and numeral 18 designates an output section for outputting the result of judgement by the change judgement section 17.

Figure 2:
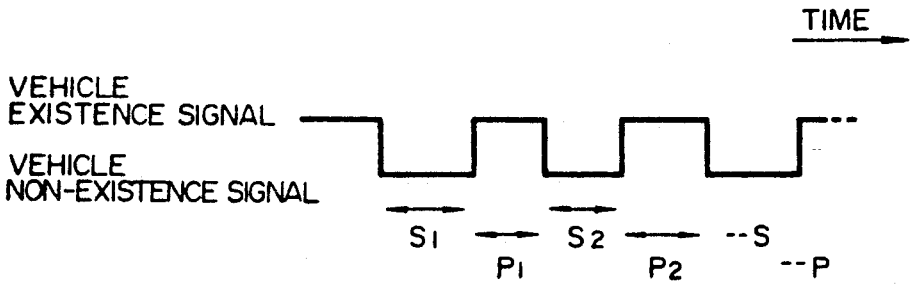
FIG. 2 is a diagram for explaining one example of a vehicle perception signal from a vehicle perceiving sensor.

Next, the operation of the above embodiment will be explained on the basis of FIGS. 1 and 2.

When a vehicle running on a road passes through perception limits of each vehicle perceiving sensor 11, the signal detection section 2 detects the passage of the vehicle as a vehicle perception signal. As shown in FIG. 2, this vehicle detection signal is a pulse signal including a vehicle existence signal of a high level corresponding to a time during which each vehicle passes through the perception limits of the vehicle perceiving sensor 11 (or a value P) and a vehicle non-existence signal of a low level corresponding to a time during which the existence of a vehicle is not detected (or a value S).

The signal detection section 12 allots numbers ($P_1$, $S_1$, $P_2$, $S_2$, . . .) to the values P and S in a sequence of running of vehicles and thereafter sends the value ($P_1$, $P_2$, . . .) to the vehicle perception data compilation section 13 and the value ($S_1$, $S_2$, . . .) to the inter-vehicle distance data compilation section 15.

The vehicle perception data compilation section 13 divides the value ($P_1$, $P_2$, . . .) by a predetermined length of an ordinary vehicle to determine the speed of each vehicle, sums up the determined vehicle speeds at every unit time to produce vehicle perception data corresponding to an average vehicle speed and sends the vehicle perception data to the vehicle perception data classification section 14. In the vehicle perception data classification section 14, the vehicle perception data is ranked on the basis of a plurality of threshold values to make a ranked classification.

On the other hand, the inter-vehicle distance data compilation section 15 counts the value ($S_1$, $S_2$, . . .) by means of clocks to determine a distance between vehicles, sums up the determined distances at every unit time to generate inter-vehicle distance data corresponding to an average distance between vehicles and sends the inter-vehicle distance data to the inter-vehicle distance data classification section 16. In the inter-vehicle distance data classification section 16, the inter-vehicle distance data is ranked on the basis of a plurality of threshold values to make a ranked classification.

The results of ranked classification concerning the vehicle perception data and the inter-vehicle distance data are both sent to the change judgement section 17. The change judgement section 17 judges a change in traffic flow by comparing the results of ranked classification concerning the vehicle perception data and the inter-vehicle distance data with a combinative decision value and monitoring a time-dependent change of the result of comparison and outputs the result of judgement through the output section 18.

In the present embodiment, an ultrasonic sensor is used as the vehicle perceiving sensor 11. However, a sensor of another type such as a sensor of an image processing type may be used so long as it can detect the running condition of each vehicle and the distance between vehicles.

Also, in the present embodiment, time-based data including a time during which a vehicle is perceived and a time during which a vehicle is not perceived, is used as data obtained from the vehicle perceiving sensor 11. However, other data may be used so long as it becomes a basis for determination of the running speed of each vehicle and a distance between vehicles.

Figure 3:
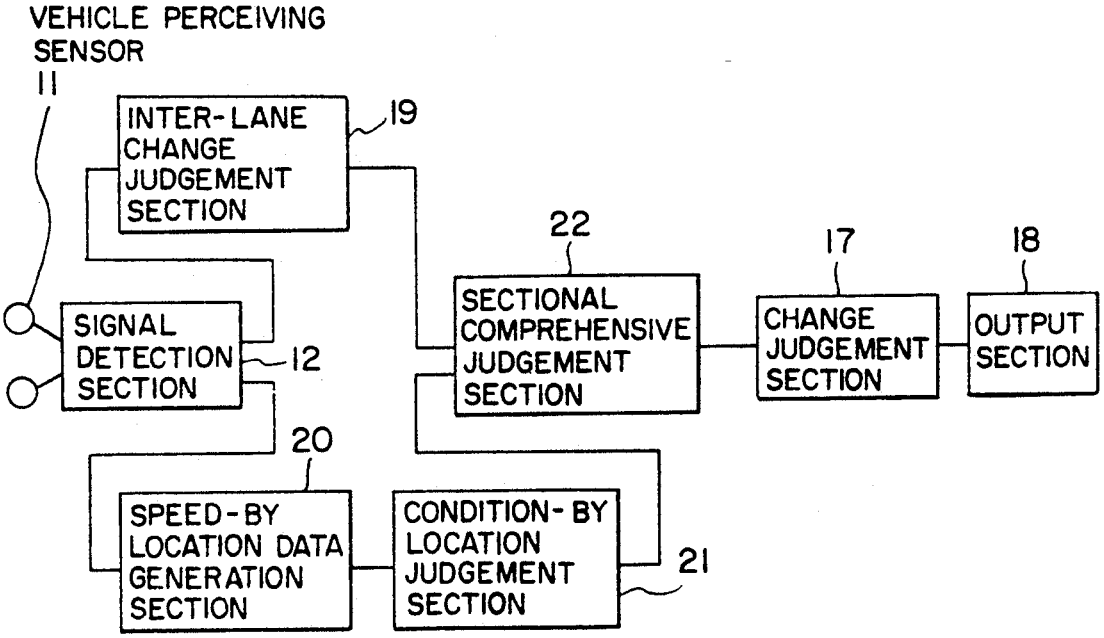
FIG. 3 is a block diagram showing the construction of a traffic flow change monitoring system according to another embodiment of the present invention, FIG. 4(*a*) is an explanatory diagram showing, an average vehicle speed for one unit time on each of a travelling lane and a passing lane determined by an inter-lane change judgement section shown in FIG. 3, FIG. 4(*b*) is an explanatory diagram showing a difference between the average vehicle speeds on the travelling and passing lanes.

FIG. 3 is a block diagram showing the construction of a traffic flow change monitoring system according to another embodiment of the present invention.

In FIG. 3, reference numeral 11 designates vehicle perceiving sensors such as ultrasonic sensors placed on a travelling lane and a passing lane at each measuring spot on a road for perceiving vehicles, and numeral 12 designates a signal detection section for detecting a vehicle perception signal from each vehicle perceiving sensor 11 to determine the speed of the perceived vehicle.

Numeral 19 designates an inter-lane change judgement section which is provided as means for determining, at each measuring spot, a difference between average vehicle speeds on a travelling lane and a passing lane from the speed of each vehicle determined by the signal detection section 12 and comparing the determined difference with a predetermined decision value concerning differences between the average vehicle speeds to decide a relative change in traffic flow between the lanes.

Numeral 20 designates a speed-by-location data generation section as means for generating vehicle speed data corresponding to an average vehicle speed for one unit time at each measuring spot from the speed of each vehicle determined by the signal detection section 12, and numeral 21 designates a condition-by-location decision section as means for comparing the vehicle speed data at each spot with a predetermined threshold value concerning vehicle speed data to decide the condition of a traffic flow at each measuring spot.

Numeral 22 designates a sectional comprehensive judgement section which is provided as means for comparing a combinative value of the results of judgement by the inter-lane change judgement section 19 and the condition-by-location decision section 21 in a predetermined road section with a predetermined threshold value concerning the sectional traffic flow condition to decide the condition of a traffic flow in the predetermined road section.

Numeral 17 designates a change judgement section as means for monitoring a time-dependent change of the result of judgement by the sectional comprehensive judgement section 22 to decide a change in traffic flow, and numeral 18 designates an output section for outputting the result of judgement by the change judgement section 17.

Next, the operation of the above embodiment will be explained on the basis of FIG. 3 and FIGS. 4(*a*) and 4(*b*).

When a vehicle running on a road passes through perception limits of each vehicle perceiving sensor 11, the signal detection section 12 detects the passage of the vehicle as a vehicle perception signal. This vehicle perception signal is, for example, a pulse signal including a vehicle existence signal of a high level corresponding to a time during which the vehicle perceiving sensor 11 perceives a vehicle and a vehicle non-existence signal of a low level corresponding to a time during which the vehicle perceiving sensor 11 does not perceive a vehicle.

The signal detection section 12 determines the speed of each passed vehicle from the pulse lengths of the vehicle existence signals of the detected vehicle perception signals and sends the determined vehicle speed data to the inter-lane change judgement section 19 and the speed-by-location data generation section 20.

Figure 4:
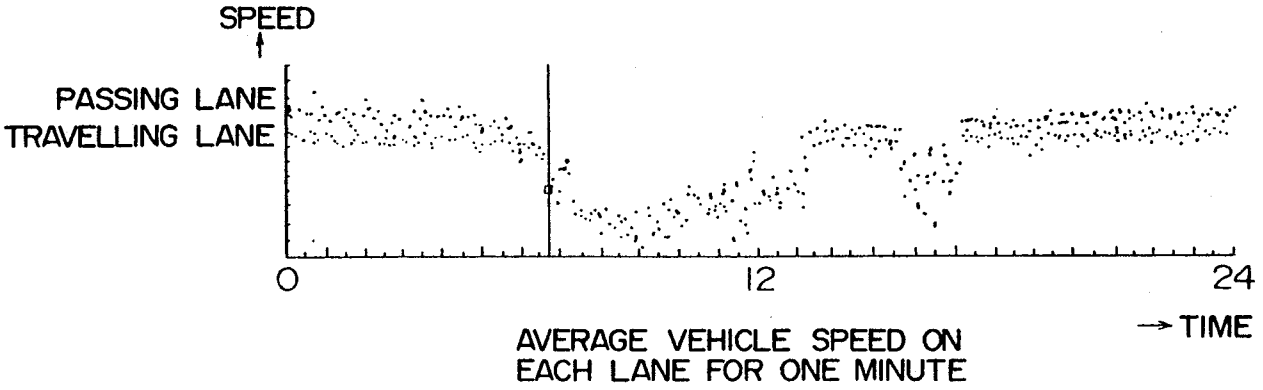
Figure 4:
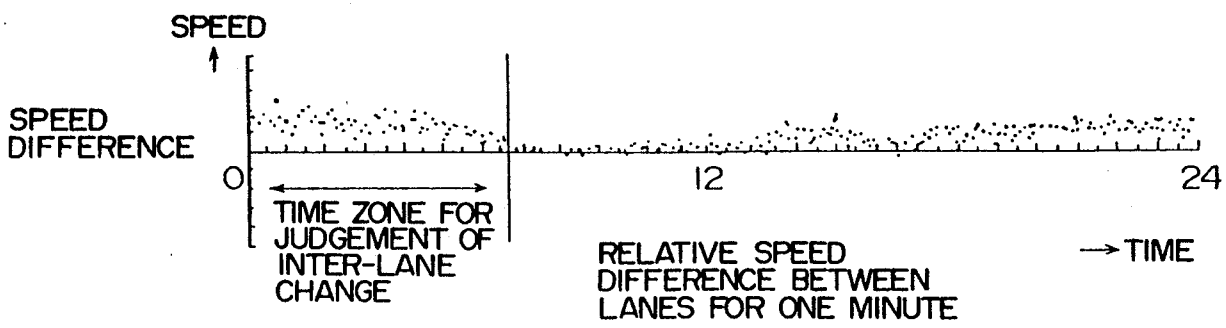
Figure 5:
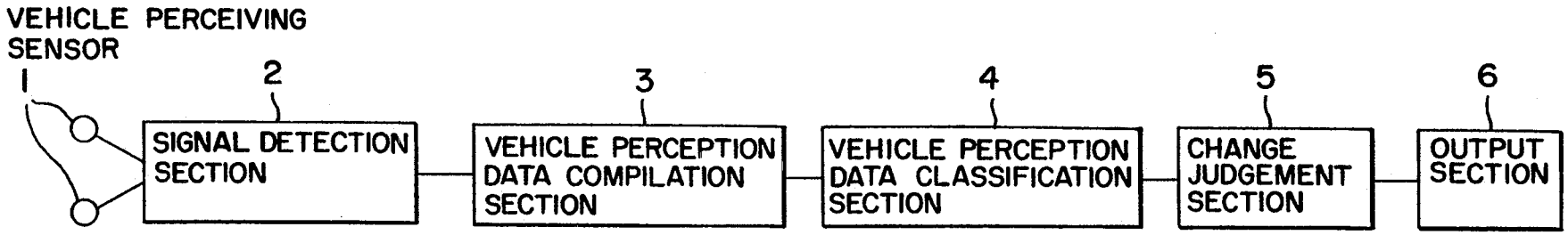
FIG. 5 PRIOR ART
FIG. 5 is a block diagram showing the construction of the conventional traffic flow change monitoring system.

In the inter-lane change judgement section 19, such average vehicle speeds for one unit time on the travelling lane, and the passing lane as shown in FIG. 4(*a*) are determined from the vehicle speed data sent from the signal detection section 12 in conjunction with vehicles which run on the travelling lane and the passing lane at a same measuring spot and in a same running direction, and such a difference between the average vehicle speeds on the two lanes as shown in FIG. 4(*b*) is determined.

The determined average vehicle speed difference is compared with a predetermined decision value concerning average vehicle speed difference. In the case where the determined value exceeds the decision value, the generation of a change in traffic flow between the travelling lane and the passing lane is determined. The obtained result of judgement is sent to the sectional comprehensive judgement section 22, for example, in the form of the presence/absence of a change and a rank indicative of degree of the change.

On the other hand, the speed-by-location data generation section 20 determines an average speed on the basis of the speed data sent from the signal in conjunction with each of the travelling lane and the passing lane at a same measuring spot and in a same running direction to produce vehicle speed data at each measuring spot.

The produced vehicle speed data is sent to the condition-by-location decision section 21 in which the vehicle speed data is compared with a predetermined threshold value concerning speed-by-location data to decide the condition of a traffic flow at each measuring spot. The result of judgement is sent to the sectional comprehensive judgement section 22, for example, in the form of a rank indicative of the condition of a traffic flow, like the case of the result of judgement by the inter-lane change judgement section 19.

The results of judgement by the inter-lane change judgement section 19 and the condition-by-location judgement section 21 sent to the sectional comprehensive judgement section 22 are collected for every road section including a plurality of measuring spots to produce a value for judgement of the condition of a traffic flow in every road section. This value is compared with a predetermined threshold value concerning sectional traffic flow condition to decide the condition of a traffic flow concerning a predetermined road section. The obtained result of judgement is sent to the change judgement section 17, for example, in the form of a rank indicative of the condition of a traffic flow.

In the change judgement section 17, the result of judgement thus sent from the sectional comprehensive judgement section 22 is compared with the previous result of judgement. The change judgement section 17 monitors a time-dependent change of the result of judgement to judge a change in traffic flow and outputs the result of judgement through the output portion 18.

In the present embodiment, an ultrasonic sensor is used as the vehicle perceiving sensor 11. However, another sensor may be used so long as it can detect the running condition of a vehicle.

Also, a vehicle speed is used as data obtained from the vehicle perceiving sensor 11. However, other data may be used so long as it represents a change in traffic flow between lanes and the condition of a traffic flow at each measuring spot. Similarly, the kinds of data used in the inter-lange change judgement section 19 and the condition-by-location judgement section 21 may be different from each other.

As has been mentioned, the present embodiment is provided with a signal detection section for detecting a vehicle perception signal from a vehicle perceiving sensor on each of lanes at each measuring spot, inter-lane change judgement means for judging a relative change in traffic flow between the lanes at each measuring spot on the basis of the vehicle perception signals detected by the signal detection section, speed-by-location data generation means for generating vehicle speed data at each measuring spot on the basis of the vehicle perception signals detected by the signal detection section, condition-by-location judgement means for deciding the condition of a traffic flow at each measuring spot on the basis of the vehicle speed data at each measuring spot generated by the speed-by-location data generation means, sectional comprehensive judgement means for judging the condition of a traffic flow in a road section inclusive of a plurality of measuring spots in accordance with the results of judgement by the inter-lane change judgement means and the condition-by-location judgement means, and change judgement means for judging a change in traffic flow in accordance with the result of judgement by the sectional comprehensive judgement means, whereby it is possible to detect a change in relative vehicle speed difference between lanes at each measuring spot.

Accordingly, it is possible to detect a relative change in traffic flow between lanes which shows an indication of a full-scale change in traffic flow over the entire lanes, thereby enabling a prompt forecast of occurrence and dissolution of a traffic congestion and a prompt detection of an expected event such as an accident.

INDUSTRIAL APPLICABILITY

As has been mentioned above, the present invention is provided with a signal detection section for detecting a vehicle perception signal from a vehicle perceiving sensor placed on a road, vehicle perception data compilation means for producing vehicle perception data from the vehicle perception signal detected by the signal detection section, vehicle perception data classification means for classifying the vehicle perception data, inter-vehicle distance data compilation means for producing inter-vehicle distance data from the vehicle perception signal detected by the signal detection section, inter-vehicle distance data classification means for classifying the inter-vehicle distance data, and change judgement means for judging a change in traffic flow in accordance with the results of classification of the vehicle perception data and the inter-vehicle distance data, whereby it is possible to monitor a change in traffic flow on the basis of both the speed or the like of individual vehicles and the distances between successive vehicles.

Accordingly, it is possible to monitor a positional relationship between successively running vehicles and it is therefore possible to make a prompt forecast of occurrence and dissolution of a traffic congestion and to make a prompt detection of an unexpected event such as an accident.

We claim:

1. A traffic flow monitoring system comprising:

a signal generating means for producing an output signal in response to vehicle perception signals generated by a vehicle perceiving sensor means disposed on a road;

vehicle perception data compilation means for producing vehicle perception data from said output signal;

vehicle perception data classification means for ranking said vehicle perception data;

inter-vehicle distance data compilation means for producing inter-vehicle distance data rom said output signal;

inter-vehicle distance data classification means for ranking said inter-vehicle distance data; and judgement means for judging a change in traffic flow by performing a comparison of results of the ranking of said vehicle perception data and the ranking of said inter-vehicle distance data with a combinative decision value and monitoring a time-dependent change in a result of said comparison.

2. A traffic flow change monitoring system comprising:

a signal detection section for detecting a vehicle perception signal from a vehicle perceiving sensor on each of traffic lanes at each measuring spot;

inter-lane change judgement means for judging a relative change in traffic flow between the traffic lanes at each measuring spot on the basis of the vehicle perception signals detected by said signal detection section;

speed-by-location data generation means for producing vehicle speed data at each measuring spot on the basis of the vehicle perception signals perceived by said signal detection section;

condition-by-location judgement means for judging the condition of a traffic flow at each measuring spot on the basis of the vehicle speed data at each measuring spot produced by said speed-by-location data generation means;

sectional comprehensive judgement means for judging the condition of a traffic flow in a section inclusive of a plurality of measuring spots in accordance with the results of judgement by said inter-lane change judgement means and said condition-by-location judgement means; and change judgement means for judging a change in traffic flow in accordance with the result of judgement by said sectional comprehensive judgement means.

* * * * *